US008184113B2

(12) United States Patent
Huang

(10) Patent No.: US 8,184,113 B2
(45) Date of Patent: May 22, 2012

(54) METHOD FOR ADJUSTING COMMON VOLTAGE OF LIQUID CRYSTAL DISPLAY DEVICE

(75) Inventor: Shun-Ming Huang, Shenzhen (CN)

(73) Assignees: Innocom Technology (Shenzhen) Co., Ltd., Shenzhen (CN); Chimei Innolux Corporation, Miaoli County (TW)

( * ) Notice: Subject to any disclaimer, the term of this patent is extended or adjusted under 35 U.S.C. 154(b) by 470 days.

(21) Appl. No.: 12/386,602

(22) Filed: Apr. 20, 2009

(65) Prior Publication Data

US 2009/0262103 A1 Oct. 22, 2009

(30) Foreign Application Priority Data

Apr. 18, 2008 (TW) ..... 97114230 A

(51) Int. Cl.
*G09G 5/00* (2006.01)

(52) U.S. Cl. ..... 345/212

(58) Field of Classification Search ..... 345/212, 345/207, 204, 104, 87, 89; 349/43, 138; 341/144

See application file for complete search history.

(56) References Cited

U.S. PATENT DOCUMENTS

| | | | | |
|---|---|---|---|---|
| 5,798,756 | A * | 8/1998 | Yoshida et al. | 345/179 |
| 5,854,881 | A * | 12/1998 | Yoshida et al. | 345/104 |
| 5,926,157 | A | 7/1999 | Moon | |
| 6,317,109 | B1 * | 11/2001 | Lee | 345/87 |
| 6,900,853 | B2 * | 5/2005 | Watanabe et al. | 349/43 |
| 7,460,047 | B2 * | 12/2008 | Zhang et al. | 341/144 |
| 7,800,603 | B2 * | 9/2010 | Wang et al. | 345/207 |
| 2005/0200786 | A1 * | 9/2005 | Watanabe et al. | 349/138 |
| 2005/0259092 | A1 * | 11/2005 | Aoki | 345/204 |
| 2009/0179882 | A1 * | 7/2009 | Uchiyama et al. | 345/207 |
| 2010/0033413 | A1 * | 2/2010 | Song et al. | 345/89 |

FOREIGN PATENT DOCUMENTS

CN 1246822 C 3/2006

* cited by examiner

*Primary Examiner* — Fred Tzeng
(74) *Attorney, Agent, or Firm* — WPAT., P.C.; Jusin King

(57) ABSTRACT

A method for adjusting a common voltage of an LCD device includes providing an LCD device and a photodetector, obtaining variable parameters Ya, Yb and Yc, the variable parameters Ya, Yb and Yc respectively denoting flicker intensity of the LCD device when the common voltages are parameters Va, Vb and Vc, Vb exceed Va, and is less than Vc, when Yb exceeds Yc and is less than Ya, increasing the parameters Va, Vb and Vc respectively and repeating the two steps, when Yb exceeds Ya and is less than Yc, decreasing the parameters Va, Vb and Vc respectively and repeating the two steps, and when Yb is less than or equals Ya and is less than or equals Yc, setting an arbitrary value between Va and Vc as an optimum common voltage of the LCD device.

20 Claims, 5 Drawing Sheets

METHOD FOR ADJUSTING COMMON VOLTAGE OF LIQUID CRYSTAL DISPLAY DEVICE

BACKGROUND

1. Technical Field

The present disclosure relates to a method for adjusting a common voltage of a liquid crystal display (LCD) device.

2. Description of Related Art

LCD devices provide portability, low power consumption, and low radiation, and find wide use in various portable information devices such as notebooks, personal digital assistants (PDAs), video cameras and others. Liquid crystal molecules of the LCD device, if driven in a direction by an electric field that remains constant for a long time, lose their physical characteristics and cannot rotate with variation of the electric field. Therefore, the direction in which the electric field drives the liquid crystal layer is periodically reverses. Generally, inversion methods of driving an LCD device include dot, column, row, and frame inversion.

In a typical frame inversion method, a common electrode of the LCD device receives an optimum common voltage. Each pixel electrode of the LCD device is provided with a first gray voltage exceeding the optimum common voltage in each odd frame. Each pixel electrode of the LCD device is provided with a second gray voltage less than the optimum common voltage in each even frame. Therefore, the direction of the electric field provided to the liquid crystal layer is periodically reversed.

While optimum common voltages of different LCD devices may differ, the inversion drive method requires the common electrode to have an optimum common voltage to avoid onscreen flicker. Thus a common voltage adjusting method is needed.

A commonly used common voltage adjusting method for an LCD device follows.

An LCD device, a photodetector, and an oscilloscope are provided. The photodetector is configured to detect an optical signal of the LCD device, and convert the optical signal into a corresponding optical current.

The common voltage of the LCD device is adjusted from a minimum voltage to a maximum voltage gradually. At the same time, the optical signal of the LCD device under each adjusted common voltage is detected by the photodetector. The optical signal is converted into a corresponding optical current, and output to the oscilloscope.

When a voltage difference between the adjusted common voltage and the optimum common voltage increases, a peak-to-peak value of the corresponding optical current increases as well and onscreen flicker intensifies. When the voltage difference between the adjusted common voltage and the optimum common voltage decreases, the peak-to-peak value of the corresponding optical current decreases as well and onscreen flicker is reduced.

A minimum value of the peak-to-peak value of the optical current is calculated, and the result is set as an optimum common voltage.

FIG. 10 shows a variation curve diagram of the peak-to-peak value of a commonly used optical current along with the variety of the common voltage, wherein x axis denotes the common voltage, and y axis denotes the peak-to-peak value of the optical current. The variation of the peak-to-peak value of the optical current is disproportional with the variety of the common voltage. Therefore, the peak-to-peak value of the optical current can be acquired only if the common voltage is adjusted from minimum to maximum gradually, a requirement degrading efficiency of adjustment method.

What is needed, therefore, is a method for adjusting a common voltage of an LCD device which can overcome the described limitations.

TECHNICAL SUMMARY

The present invention relates to a method for adjusting common voltage of a liquid crystal display. The method includes step a: providing a liquid crystal display and a light sensor; step b: attaining variables $Y_a$, $Y_b$ and $Y_c$ denoting flicker intensity by means of measuring the liquid crystal display with the light sensor respectively according to common voltage $V_a$, $V_b$ and $V_c$, wherein $V_a<V_b<V_c$; and step c: if $Y_a>Y_b>Y_c$, respectively increasing $V_a$, $V_b$ and $V_c$, and going to step b; if $Y_a<Y_b<Y_c$, respectively decreasing $V_a$, $V_b$ and $V_c$, and going to step b; if $Y_a \geqq Y_b \geqq Y_c$, seting any value between $V_a$ and $V_c$ as optimal common voltage of the liquid crystal display.

In another embodiment, the present invention further relates to a method for adjusting common voltage of a liquid crystal display, comprising: step a: providing a liquid crystal display and a light sensor; step b: attaining variables $Y_a$, $Y_b$ and $Y_c$ denoting flicker intensity by means of measuring the liquid crystal display with the light sensor respectively according to common voltage $V_a$, $V_b$ and $V_c$, wherein $V_a<V_b<V_c$; and step c: if $Y_a>Y_b>Y_c$, respectively decreasing $V_a$, $V_b$ and $V_c$, and going to step b; if $Y_a<Y_b<Y_c$, respectively increasing $V_a$, $V_b$ and $V_c$, and going to step b; if $Y_a \geqq Y_b \geqq Y_c$, seting any value between $V_a$ and $V_c$ as optimal common voltage of the liquid crystal display.

In summary, the method for adjusting the common voltage of the LCD device first sets a predetermined optimum common voltage, then increases or decreases the predetermined optimum common voltage directly and automatically for obtaining an optimum common voltage. Because the method needs not test all common voltage values, the efficiency for adjusting the common voltage of the LCD device is comparatively high.

DETAILED DESCRIPTION

Reference will now be made to the drawings to describe preferred and exemplary embodiments of the disclosure in detail.

Figure 1:
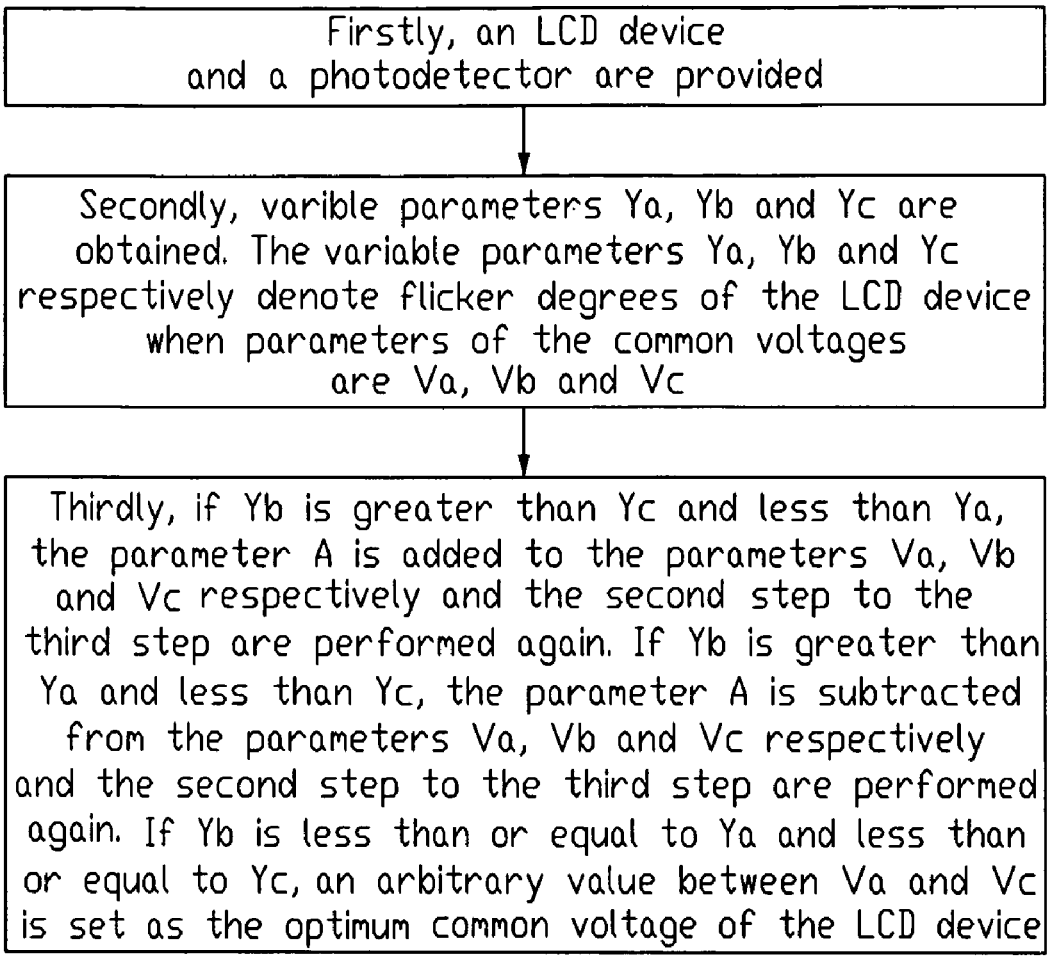
FIG. 1 is a flowchart of a first embodiment of a method for adjusting a common voltage of an LCD device according to the disclosure.

FIG. 1 is a flowchart of a first embodiment of a method for adjusting a common voltage of an LCD device according to the disclosure. The method is described as follows.

An LCD device and a photodetector are provided. The LCD device includes a common voltage generating circuit outputting a common voltage with a minimum value Vcom1 and a maximum value Vcom2. The photodetector is configured to detect an optical signal of the LCD device, and convert the optical signal into a corresponding optical current.

Variable parameters Ya, Yb and Yc are obtained, respectively denoting flicker intensities of the LCD device when parameters of the common voltages are Va, Vb and Vc. The parameter Vb exceeds the parameter Va, and is less than the parameter Vc. The difference value between Vb and Va equals a parameter A, as is the difference value between Vc and Vb.

In S1, the common voltage of the LCD device is set as the parameter Va, which exceeds or equals the minimum value Vcom1, and is less than or equals the maximum value Vcom2. The parameter Va can be a predetermined optimum common voltage.

Figure 2:
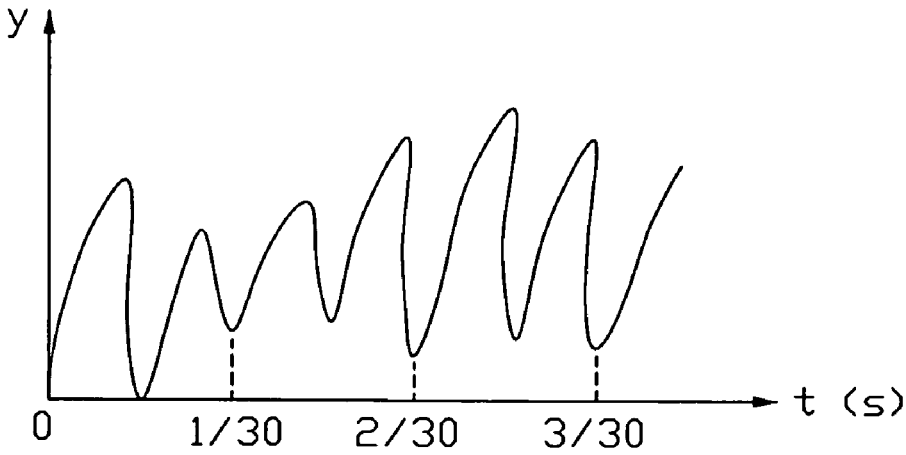
FIG. 2 is a variation curve diagram of a first electrical signal along with time variation, the first electrical signal as described in the common voltage adjusting method of FIG. 1.

In S2, an optical signal of the LCD device along with time variation is detected, and a corresponding first electrical signal generated. FIG. 2 is a variation curve diagram of the first electrical signal along with time variation, wherein x axis denotes the time, and y axis denotes the first electrical signal. The first electrical signal is an analog optical current signal.

In S3, the first electrical signal is converted to a first digital electrical signal through an analog-digital converter. Noise of the first digital electrical signal is filtered through a digital signal processor (DSP). A second electrical signal is isolated from the filtered first digital electrical signal through the DSP. Frequency of the second electrical signal is half of a refresh rate of the LCD device.

A peak-to-peak value of a first half cycle of the second electrical signal denotes a maximum value of an optical signal in a frame image. A peak-to-peak value of a second half cycle of the second electrical signal denotes a maximum value of an optical signal in a subsequent frame image. An absolute value of the peak-to-peak value of the second electrical signal is defined as follows. The absolute value of the peak-to-peak value of the second electrical signal is an absolute value of a difference value between the peak-to-peak values of the first half cycle and the second half cycle of the second electrical signal. Therefore, the absolute value of the peak-to-peak value of the second electrical signal also denotes a difference value of maximum luminances of two adjacent frame images.

Figure 3:
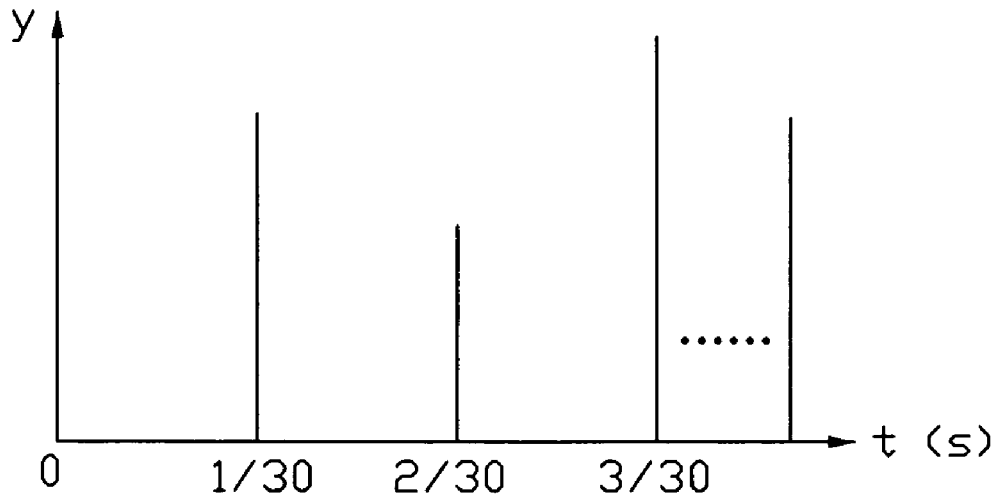
FIG. 3 is a discrete image of an absolute value of a peak-to-peak value of a second electrical signal, the second signal as described in the common voltage adjusting method of FIG. 1.

FIG. 3 shows an individual absolute value of the peak-to-peak value of the second electrical signal, wherein x axis denotes the time, and y axis denotes the absolute value of the peak-to-peak value of the second electrical signal.

In S4, an average of the absolute value of the peak-to-peak value of the second electrical signal for a predetermined period is calculated based on the absolute value of the peak-to-peak value of the second electrical signal being variable. The average value is the variable parameter Ya. As average value Ya increases, the flicker intensity of the LCD device increases correspondingly. With reduction in average value Ya, flicker of the LCD device is reduced accordingly.

In S5, average values Yb and Yc are obtained, by a method similar to those of S1 to S4.

If Yb exceeds Yc and is less than Ya, the parameter A is added to the parameters Va, Vb and Vc respectively and the second to third steps are repeated. If Yb exceeds Ya and is less than Yc, the parameter A is subtracted from the parameters Va, Vb and Vc respectively and the second and third steps are repeated. If Yb is less than or equals Ya and is less than or equals Yc, an arbitrary value between Va and Vc is set as the optimum common voltage of the LCD device.

Figure 4:
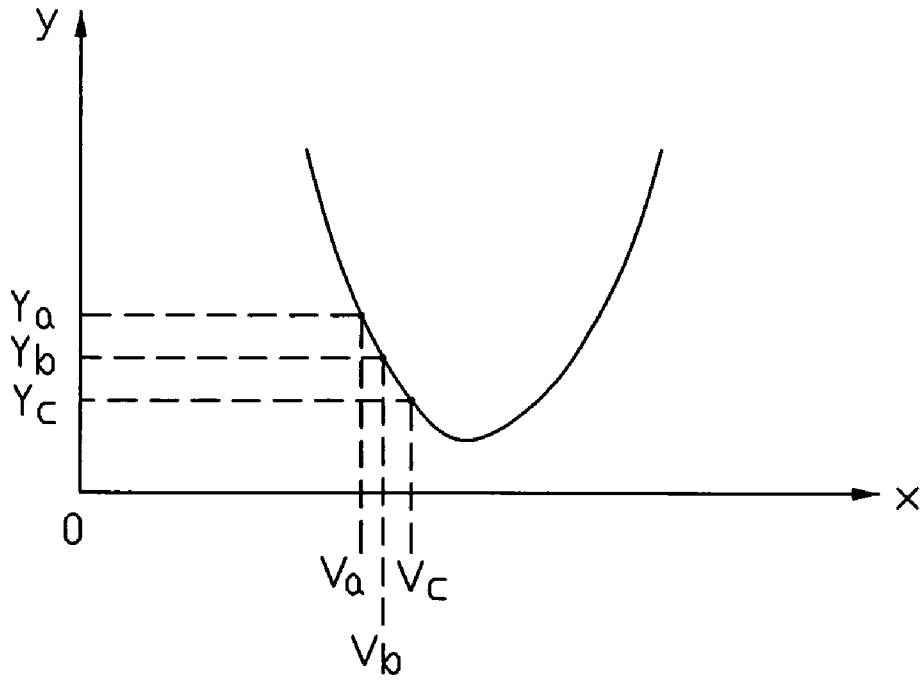
FIGS. 4, 5, 6 show variation curve diagrams of an average of the absolute value of FIG. 3 along with the variety of the common voltage.
Figure 5:
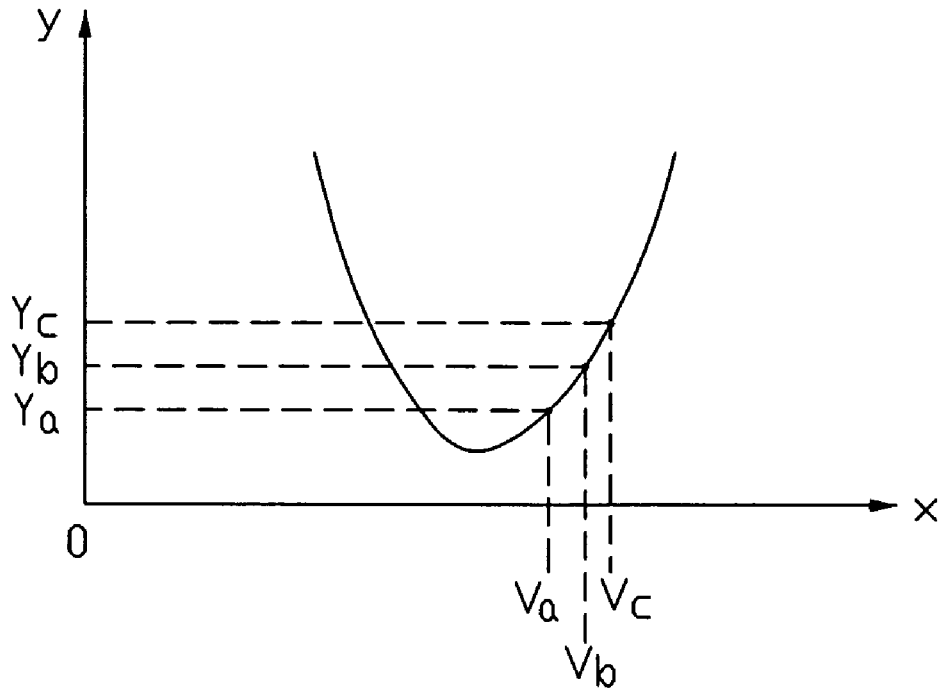
Figure 6:
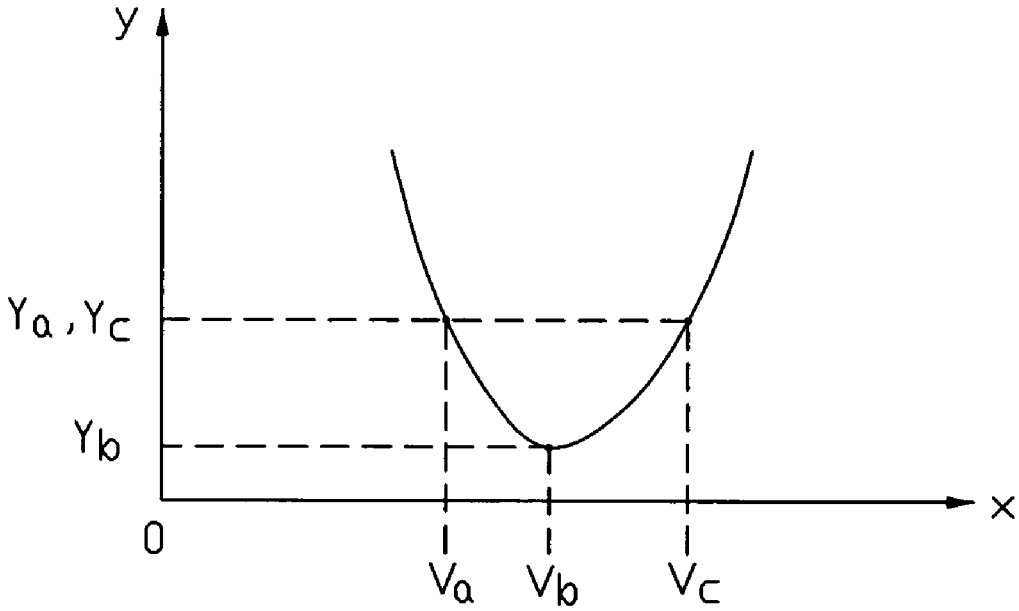

FIGS. 4, 5, 6 show variation curve diagrams of the average of the absolute value of FIG. 3 along with the variety of the common voltage, wherein x axis denotes the common voltage, and y axis denotes the average of the absolute value of the peak-to-peak value of the second electrical signal. As shown in FIG. 4, when Yb exceeds Yc and is less than Ya, the average of the absolute value proportionally decreases with the increase in common voltage. As shown in FIG. 5, when Yb exceeds Ya and is less than Yc, the average of the absolute value proportionally increases with the increase of the common voltage. As shown in FIG. 6, when Yb is less than or equals Ya and is less than or equals Yc, the common voltage corresponding to a minimum value of the average of the absolute value is disposed between Va and Vc. Therefore, the optimum common voltage of the LCD device can be the any value between Va and Vc. For example, the optimum common voltage of the LCD device can be Vb or (Va+Vc)/2.

In summary, the method for adjusting the common voltage of the LCD device first sets a predetermined optimum common voltage, then increases or decreases the predetermined optimum common voltage directly and automatically for obtaining an optimum common voltage. Because the method needs not test all common voltage values, the efficiency for adjusting the common voltage of the LCD device is comparatively high.

Figure 7:
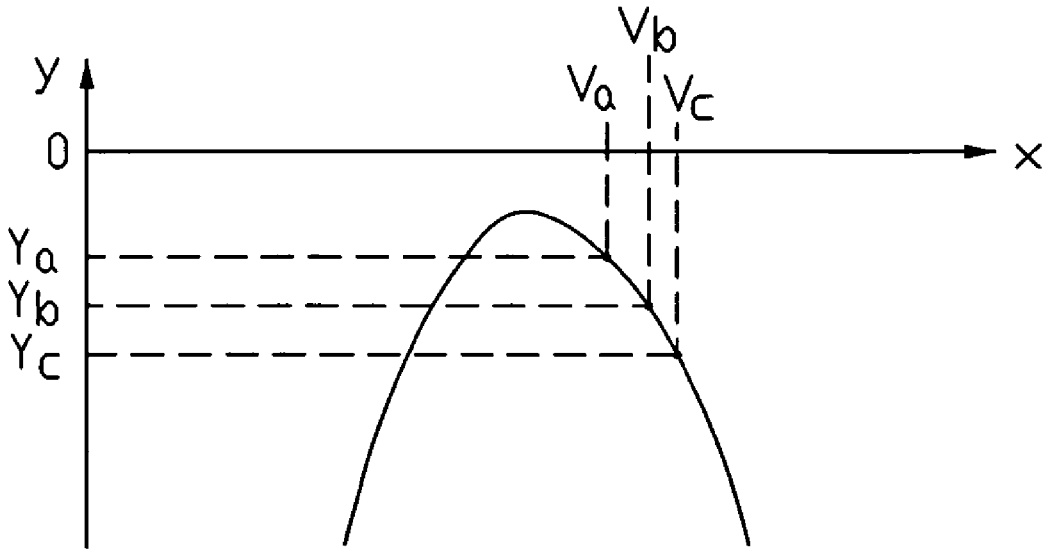
FIGS. 7, 8, 9 are variation curve diagrams of a second embodiment of a method for adjusting a common voltage of an LCD device, in which are shown negative average of an absolute value of a peak-to-peak value of a second electrical signal along with the variety of the common voltage according to the disclosure.
Figure 8:
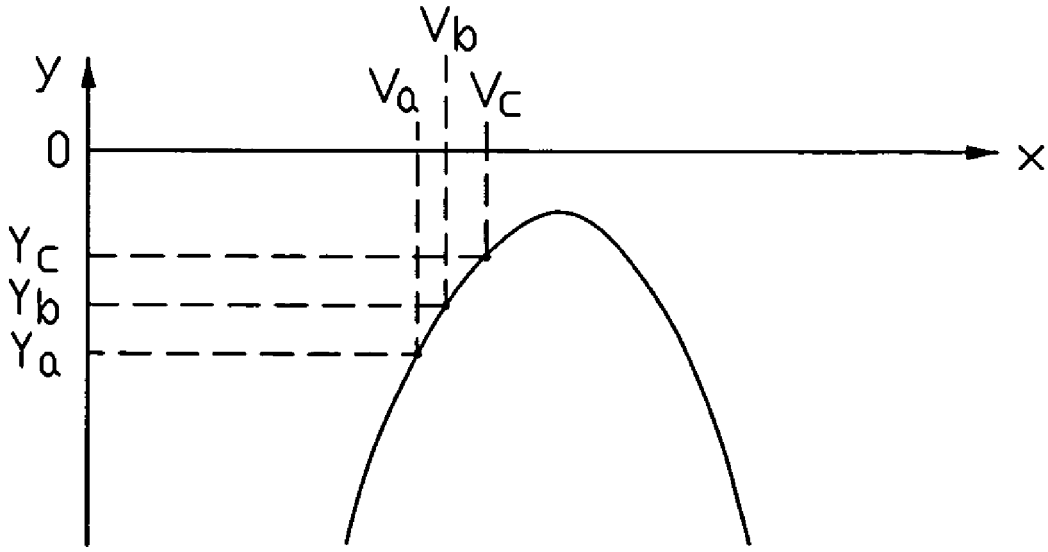
Figure 9:
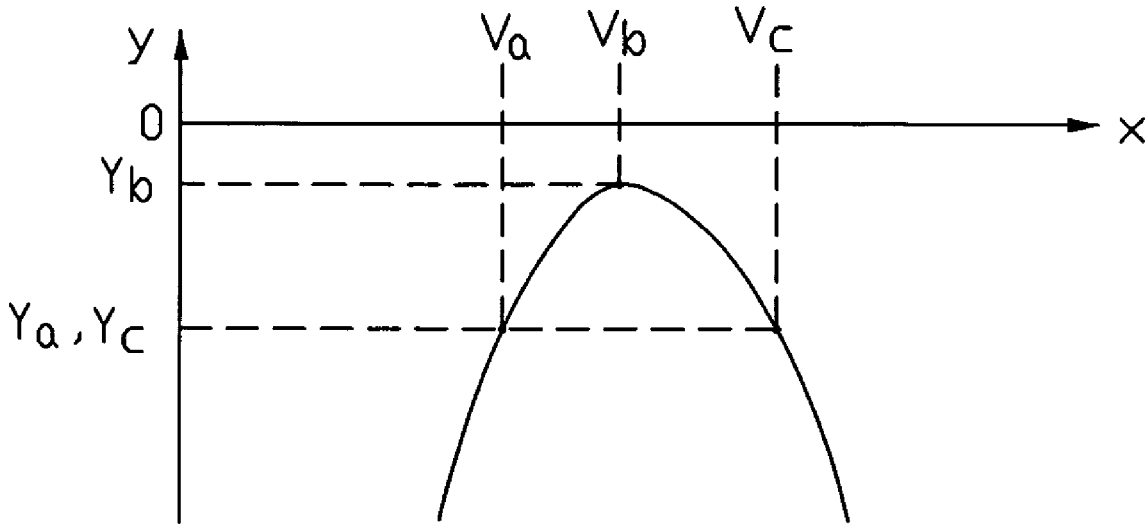
Figure 10:
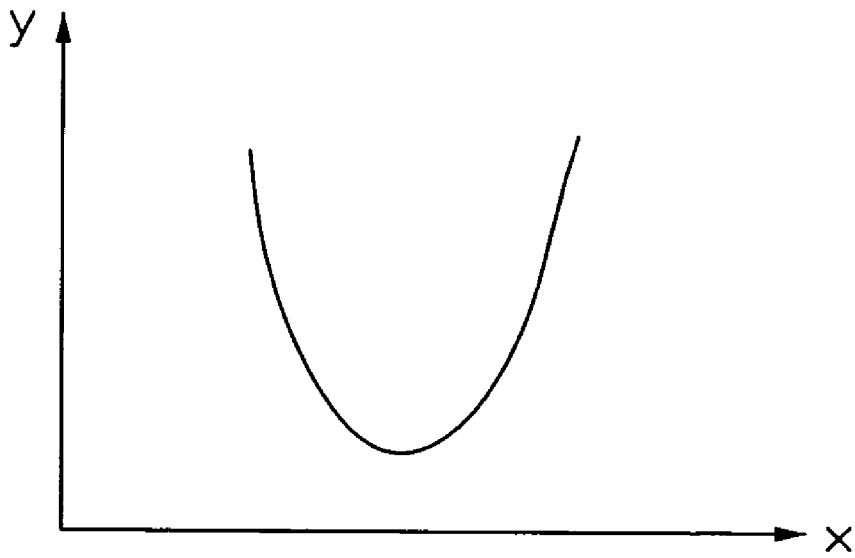
FIG. 10 is a variation curve diagram of the peak-to-peak value of a commonly used optical current along with the variety of the common voltage.

FIGS. 7, 8, 9 are variation curve diagrams of a second embodiment of a method for adjusting a common voltage of an LCD device, in which are shown negative average of an absolute value of a peak-to-peak value of a second electrical signal along with the variety of the common voltage according to the disclosure, wherein x axis denotes the common voltage, and y axis denotes the negative average of the absolute value of the peak-to-peak value of the second electrical signal. The method of the second embodiment differs from that of the first embodiment only in the third step of the method. Here, if Yb exceeds Yc and is less than Ya, a parameter A is subtracted from the parameters Va, Vb and Vc respectively and the second and third steps are repeated. If Yb exceeds Ya and is less than Yc, the parameter A is added to the parameters Va, Vb and Vc respectively and the second and third steps are repeated. If Yb exceeds or equals Ya and exceeds or equals Yc, an arbitrary value between Va and Vc is set as the optimum common voltage of the LCD device. For example, the optimum common voltage of the LCD device can be Vb or (Va+Vc)/2, if Yb exceeds or equals Ya and exceeds or equals Yc.

It is to be further understood that even though numerous characteristics and advantages of preferred and exemplary embodiments have been set out in the foregoing description, together with details of structures and functions associated with the embodiments, the disclosure is illustrative only, and changes may be made in detail (including in matters of arrangement of parts) within the principles of the disclosure to the full extent indicated by the broad general meaning of the terms in which the appended claims are expressed.

What is claimed is:

1. A method for adjusting a common voltage of a liquid crystal display (LCD) device, the method comprising:

step a: providing an LCD device and a photodetector;

step b: obtaining variable parameters Ya, Yb and Yc using the photodetector, the variable parameters Ya, Yb and Yc respectively denoting flicker intensity of the LCD device when the common voltages are parameters Va, Vb and Vc, Vb exceeding Va, and less than Vc;

step c: comparing Yb, Yc and Ya obtained by the step b, wherein when Yb exceeds Yc and is less than Ya, going to step d; when Yb exceeds Ya and is less than Yc, going to step e; when Yb is less than or equals Ya and is less than or equals Yc, going to step f;

step d: increasing the parameters Va, Vb and Vc respectively, and going to the step b;

step e: decreasing the parameters Va, Vb and Vc respectively, and going to the step b; and step f: setting an arbitrary value between Va and Vc as an optimum common voltage of the LCD device;

wherein the variable parameters Ya, Yb and Yc are directly proportional to the flicker intensity of the LCD device.

2. The method of claim 1, wherein the parameter Va is a predetermined optimum common voltage.

3. The method of claim 1, wherein a difference value between Vb and Va equals that between Vc and Vb.

4. The method of claim 3, wherein the step d comprises: adding a parameter A to the parameters Va, Vb and Vc respectively and the step e comprises: subtracting the parameter A from the parameters Va, Vb and Vc respectively.

5. The method of claim 3, wherein when Yb is less than or equals Ya and is less than or equals Yc, setting Vb as the optimum common voltage of the LCD device.

6. The method of claim 1, wherein when Yb is less than or equals Ya and is less than or equals Yc, setting (Va+Vc)/2 as the optimum common voltage of the LCD device.

7. The method of claim 1, further comprising a step of setting the common voltage of the LCD device as the parameter Va, detecting an optical signal of the LCD device along with time variation and outputting a corresponding first electrical signal using the photodetector, converting the first electrical signal to a first digital electrical signal via an analog-digital converter, isolating a second electrical signal from the first digital electrical signal after the step a and before the step b, wherein the frequency of the second electrical signal is half of a refresh rate of the LCD device, and calculating an average of an absolute value of a peak-to-peak value of the second electrical signal, wherein the average value is regarded as the variable parameter Ya denoting flicker intensity of the LCD device when the common voltage is Va.

8. The method of claim 7, further comprising, after conversion of the first electrical signal to the first digital electrical signal, filtering noise from the first digital electrical signal.

9. The method of claim 7, further comprising a step of setting the common voltage of the LCD device as the parameter Vb, detecting an optical signal of the LCD device along with time variation and outputting a corresponding first electrical signal using the photodetector, converting the first electrical signal to a first digital electrical signal through an analog-digital converter, isolating a second electrical signal from the first digital electrical signal after the step a and before the step b, wherein the frequency of the second electrical signal is half of a refresh rate of the LCD device, and calculating an average of an absolute value of a peak-to-peak value of the second electrical signal, wherein the average value is regarded as the variable parameter Yb denoting flicker intensity of the LCD device when the common voltage is Vb.

10. The method of claim 9, further comprising, after converting the first electrical signal to the first digital electrical signal, filtering noise from the first digital electrical signal.

11. The method of claim 9, further comprising a step of setting the common voltage of the LCD device as the parameter Vc, detecting an optical signal of the LCD device along with time variation and outputting a corresponding first electrical signal using the photodetector, converting the first electrical signal to a first digital electrical signal through an analog-digital converter, isolating a second electrical signal from the first digital electrical signal after the step a and before the step b, wherein the frequency of the second electrical signal is half of a refresh rate of the LCD device, and calculating an average of an absolute value of the peak-to-peak value of the second electrical signal, wherein the average value is regarded as the variable parameter Yc denoting flicker intensity of the LCD device when the common voltage is Vc.

12. The method of claim 11, further comprising after converting the first electrical signal to the first digital electrical signal, filtering noise from the first digital electrical signal.

13. A method for adjusting a common voltage of a liquid crystal display (LCD) device, the method comprising:

step a: providing an LCD device and a photodetector;

step b: obtaining variable parameters Ya, Yb and Yc using the photodetector, the variable parameters Ya, Yb and Yc respectively denoting flicker intensity of the LCD device when the common voltages are parameters Va, Vb and Vc, Vb exceeding Va, and less than Vc;

step c: comparing Yb, Yc and Ya obtained by the step b, wherein when Yb exceeds Yc and is less than Ya, going to step d; when Yb exceeds Ya and is less than Yc, going to step e; when Yb is less than or equals Ya and is less than or equals Yc, going to step f;

step d: decreasing the parameters Va, Vb and Vc respectively, and going to the step b;

step e: increasing the parameters Va, Vb and Vc respectively, and going to the step b; and step f: setting an arbitrary value between Va and Vc as an optimum common voltage of the LCD device;

wherein the variable parameters Ya, Yb and Yc are inversely proportional to the flicker intensity of the LCD device.

14. The method of claim 13, wherein the parameter Va is a predetermined optimum common voltage.

15. The method of claim 13, wherein a difference value between Vb and Va equals that between Vc and Vb.

16. The method of claim 15, wherein the step e comprises: adding a parameter A to the parameters Va, Vb and Vc respectively, and the step e comprises: subtracting the parameter A from the parameters Va, Vb and Vc respectively.

17. The method of claim 13, wherein when Yb is less than or equals Ya and is less than or equals Yc, setting Vb or (Va+Vc)/2 as the optimum common voltage of the LCD device.

18. The method of claim 13, further comprising a step of setting the common voltage of the LCD device as the parameter Va, detecting an optical signal of the LCD device along with time variation and outputting a corresponding first electrical signal using the photodetector, converting the first electrical signal to a first digital electrical signal through an analog-digital converter, isolating a second electrical signal from the first digital electrical signal after the step a and before the step b, wherein the frequency of the second electrical signal is half of a refresh rate of the LCD device, and calculating an average of an absolute value of a peak-to-peak value of the second electrical signal, wherein the average value is regarded as the variable parameter Ya denoting flicker intensity of the LCD device when the common voltage is Va.

19. The method of claim 18, further comprising a step of setting the common voltage of the LCD device as the parameter Vb, detecting an optical signal of the LCD device along with time variation and outputting a corresponding first electrical signal using the photodetector, converting the first electrical signal to a first digital electrical signal through an analog-digital converter, isolating a second electrical signal from the first digital electrical signal, wherein the frequency of the second electrical signal is half of a refresh rate of the LCD device, and calculating an average of an absolute value of a peak-to-peak value of the second electrical signal after the step a and before the step b, wherein the average value is regarded as the variable parameter Yb denoting flicker intensity of the LCD device when the common voltage is Vb.

20. The method of claim 19, further comprising a step of setting the common voltage of the LCD device as the parameter Vc, detecting an optical signal of the LCD device along with time variation and outputting a corresponding first electrical signal using the photodetector, converting the first electrical signal to a first digital electrical signal through an analog-digital converter, isolating a second electrical signal from the first digital electrical signal after the step a and before the step b, wherein the frequency of the second electrical signal is half of a refresh rate of the LCD device, and calculating an average of an absolute value of a peak-to-peak value of the second electrical signal, wherein the average value is regarded as the variable parameter Yc denoting flicker intensity of the LCD device when the common voltage is Vc.

* * * * *